US007929874B2

(12) United States Patent
Takiguchi et al.

(10) Patent No.: US 7,929,874 B2
(45) Date of Patent: Apr. 19, 2011

(54) TRANSFER DEVICE AND IMAGE FORMING APPARATUS USING THE SAME

(75) Inventors: Toshiki Takiguchi, Yamatokoriyama (JP); Hideshi Izumi, Ikoma (JP); Takahiko Yoshida, Nara (JP); Hiroyuki Murai, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 191 days.

(21) Appl. No.: 12/358,305

(22) Filed: Jan. 23, 2009

(65) Prior Publication Data

US 2009/0196640 A1 Aug. 6, 2009

(30) Foreign Application Priority Data

Feb. 6, 2008 (JP) ..... 2008-026275

(51) Int. Cl.
*G03G 21/00* (2006.01)
*G03G 15/16* (2006.01)

(52) U.S. Cl. ..... 399/34; 399/101

(58) Field of Classification Search ..... 399/101, 399/31, 43, 296
See application file for complete search history.

(56) References Cited

U.S. PATENT DOCUMENTS

| | | | | |
|---|---|---|---|---|
| 5,333,037 | A | * | 7/1994 | Inoue et al. |
| 7,085,514 | B2 | * | 8/2006 | Kaneko |
| 2006/0245782 | A1 | | 11/2006 | Hirai et al. |

FOREIGN PATENT DOCUMENTS

| | | | | |
|---|---|---|---|---|
| JP | 04-109278 | A | | 4/1992 |
| JP | 11-352793 | | | 12/1999 |
| JP | 2006138891 | A | * | 6/2006 |
| JP | 2006-243055 | | | 9/2006 |
| JP | 2006-308816 | A1 | | 11/2006 |
| JP | 2007121379 | A | * | 5/2007 |

* cited by examiner

*Primary Examiner* — Susan S Lee
(74) *Attorney, Agent, or Firm* — Birch, Stewart, Kolasch & Birch, LLP

(57) ABSTRACT

A transfer device includes a transfer device controller for controlling the whole transfer device, a storage for storing various kinds of data etc. necessary for control, an intermediate transfer unit including a primary transfer power supply and its driver, a secondary transfer unit including a secondary transfer power supply and its driver, and a PTC unit. In the transfer device, a controller communicates with a main controller that controls the whole image forming apparatus, and acquires, for example, information on the total print count or the like. When PTC radiation is determined to be needed based on the above information, the controller controls to drive the PTC unit.

7 Claims, 6 Drawing Sheets

TRANSFER DEVICE AND IMAGE FORMING APPARATUS USING THE SAME

This Nonprovisional application claims priority under 35 U.S.C. §119(a) on Patent Application No. 2008-026275 filed in Japan on 6 Feb. 2008, the entire contents of which are hereby incorporated by reference.

BACKGROUND OF THE INVENTION (1) Field of the Invention

The present invention relates to a transfer device that performs electrical cleaning as well as to an image forming apparatus using this transfer device.

(2) Description of the Related Art

Conventionally, color image forming apparatuses such as copiers, printers, facsimile machines and the like, include a transfer device for transferring a color toner image formed by the image forming portions, to recording paper. As one of known transfer mechanisms of such a transfer device there is an intermediate transfer system in which toner images of different colors formed at the image forming units corresponding to each color are successively transferred to an intermediate transfer element or a belt so that each toner image is laid over the others (primary transfer) and the thus layered color toner image is transferred onto recording paper by a single transfer step (second transfer).

When a transfer scheme of this kind is adopted, "fogging toner" caused by residual potential other than the toner image transfers to the transfer belt, causing soil on the transfer belt. As a result, the transfer belt needs a cleaning mechanism.

Usually, most of the cleaning mechanisms are constructed of a mechanical structure using a cleaning blade. However, when the transfer belt to be cleaned is thin and soft, it is not beneficial to abut and press a hard blade against the transfer belt of this kind because various problems such as occurrence of wrinkles in the belt, occurrence of meandering of the belt and in the worst case, a rupture of the belt occur. From this viewpoint, there is a disclosure of a technology relating to electrical cleaning for performing preferable cleaning of the toner adhering on the secondary transfer element such as a transfer belt, transfer roller or the like, by alternatively impressing a negative electric field that causes negatively charged toner adhering to the secondary transfer belt to return from the secondary transfer belt to the intermediate transfer belt and a positive electric field that causes positively charged toner adhering to the secondary transfer belt to return from the secondary transfer belt to the intermediate transfer belt (patent document 1: Japanese Patent Application Laid-open 2006-308816).

However, when electric cleaning of the secondary transfer belt (causing the residual toner to return from the secondary transfer belt to the primary transfer belt side) is performed in the above way, this method suffers the problem that if the amount of static charge has lowered due to deterioration of the developer (toner) or exposure of the developer to high humidity environments, the cleaning performance lowers hence the toner fails to return from the secondary transfer belt toward the primary transfer belt.

SUMMARY OF THE INVENTION

The present invention has been achieved in view of the above circumstances, it is therefore an object of the present invention to provide a transfer device and an image forming apparatus including the transfer device, wherein the amount of static charge on the toner on the transfer belt is restored so as to constantly stabilize the ability to clean the secondary transfer belt and shorten cleaning time.

In order to solve the above problem, according to the present invention the transfer device and image forming apparatus including this are constructed and characterized as follows.

A transfer device according to the present invention includes: a secondary transfer element for transferring the toner on a primary transfer element to print paper; a pre-transfer charging unit for increasing the amount of static charge on the toner before the toner on the primary transfer element transfers to the secondary transfer element; a predictive information acquisitor for acquiring predictive information for previously detecting occurrence of cleaning failure in the secondary transfer element; and a controller for causing the pre-transfer charging unit so as to control the amount of static charge on the toner on the primary transfer element, wherein the controller compares the predictive information obtained from the predictive information acquisitor with a predetermined threshold, and makes control so as to increase the amount of static charge when detecting the predictive information falling below the threshold, and determining that cleaning failure can occur.

In the transfer device of the present invention, the pre-transfer charging unit may be arranged over a primary transfer belt at a position immediately before a secondary transfer belt.

In the transfer device of the present invention, the predictive information may be the total print count.

In the transfer device of the present invention, the controller may be constructed so as to cause the pre-transfer charging unit to vary the drive condition of charging based on the total print count.

In the transfer device of the present invention, the controller may perform a cleaning process of the secondary transfer element at the time when image quality control for an image forming apparatus is practiced.

In the transfer device of the present invention, the controller may perform a cleaning process of the secondary transfer element every time one print job of an image forming apparatus has been finished.

An image forming apparatus of the present invention may also include the transfer device according to the present invention.

The transfer device of the present invention and the image forming apparatus including this device have the excellent effect as follows.

According to the transfer device of the present invention, when the amount of static charge on the developer is expected to be lowered, charge radiation from the PTC is effected over the primary transfer belt so as to restore the amount of static charge on the toner over the belt, whereby it is possible to constantly stabilize the performance of cleaning the secondary transfer belt and reduce the cleaning time.

Further, according to the transfer device of the present invention, it is possible to remove the unnecessary toner that appears when image patches are formed at the time of image quality control for the image forming apparatus.

Also, according to the transfer device of the present invention, it is possible to remove the unnecessary toner that appears when one print job in the image forming apparatus has been finished.

DESCRIPTION OF THE INVENTION

Figure 1:
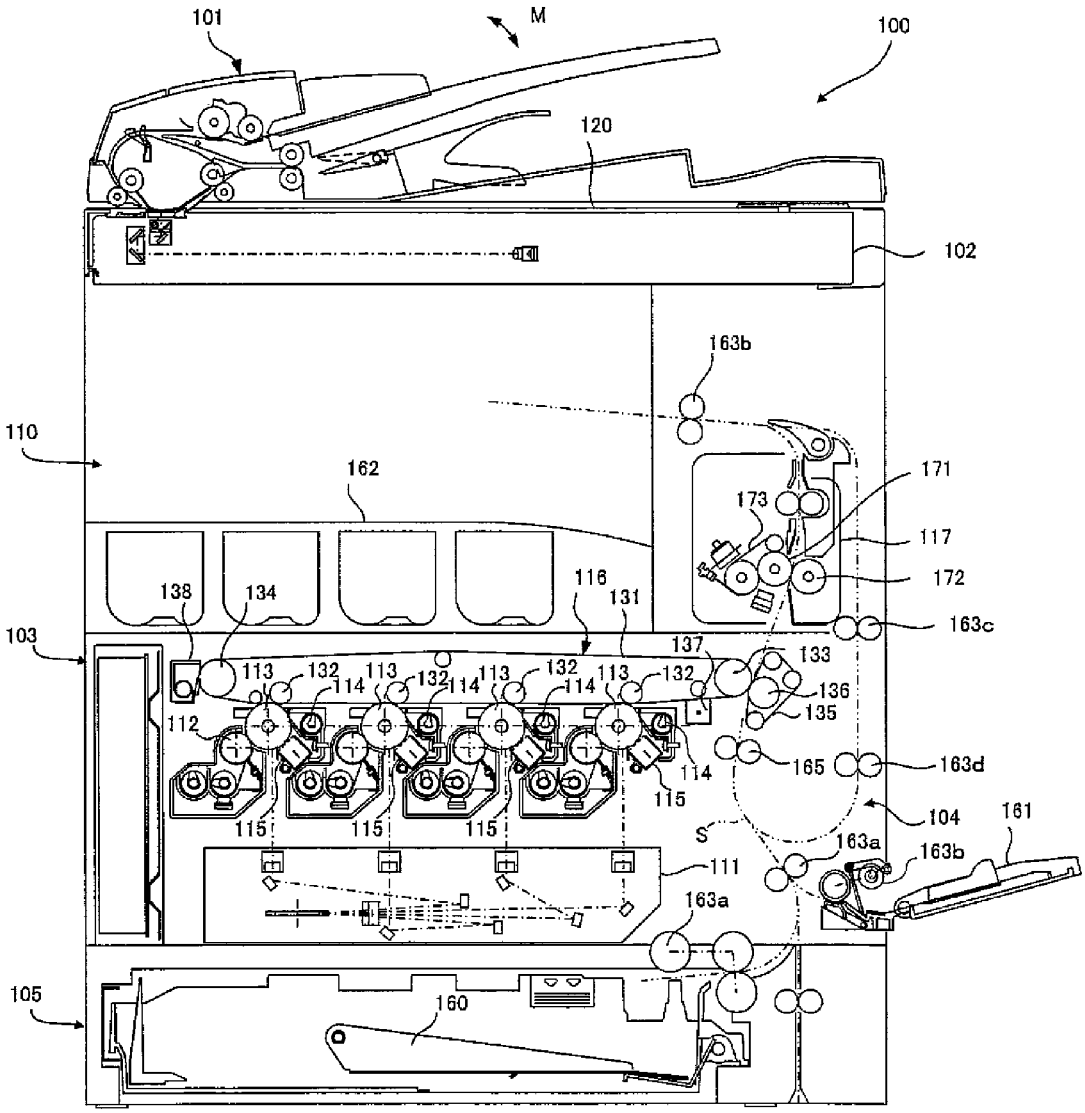
FIG. 1 is a view showing a configurational example an image forming apparatus including a transfer device according to the present invention.

An embodied mode of a transfer device of the present invention and an image forming apparatus including this will hereinafter be described with reference to the accompanying drawings.

FIGS. 1 to 6 are views showing one example of the embodiment of a transfer device according to the present invention and an image forming apparatus including this. In the drawings, the components allotted with the same reference numerals will represent identical components.

<Description on the Overall Configuration and Operation of an Image Forming Apparatus of the Present Invention>

To begin with, the overall configuration and operation of the image forming apparatus will be briefly described before giving description on the specific configuration and operation of the transfer device according to the present invention.

Figure 2:
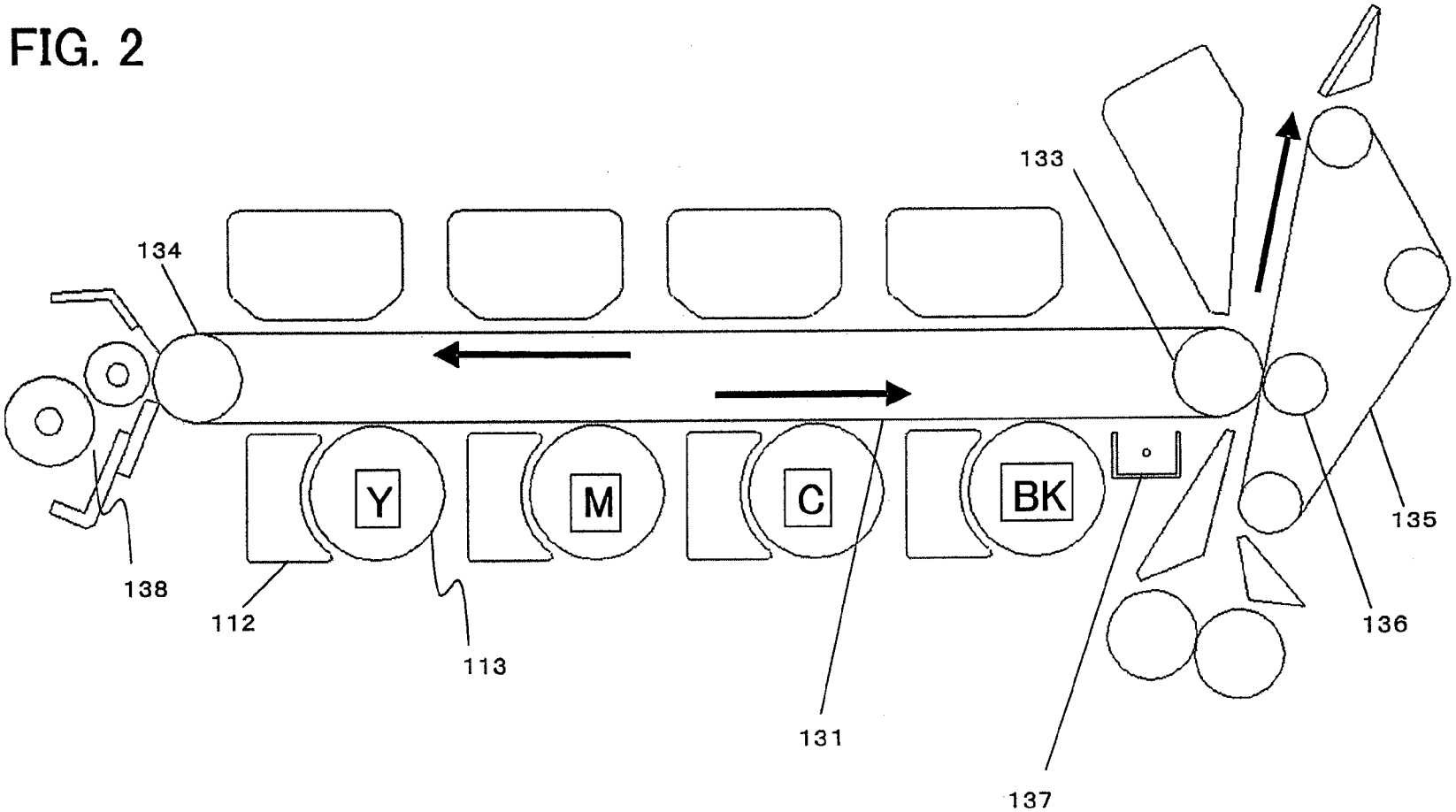
FIG. 2 is a view showing a configurational example including peripheral devices around a transfer device according to the present invention.

FIG. 1 is a view showing a configurational example of an image forming apparatus including a transfer device according to the present invention. FIG. 2 is a view showing a configurational example of a transfer device with its peripheral devices according to the present invention.

An image forming apparatus 100 forms a multi-colored or monochrome image on predetermined recording paper (which will be referred to hereinbelow as a sheet) in accordance with image data input from without, and is essentially composed of an automatic document processor (ADF) 101, an image reader 102, an image forming portion 103, a sheet feed portion 104 and a paper feed unit 105.

Particularly, among the above constituents, image forming portion 103 is to record an original image represented by image data on a sheet and includes an exposure unit 111, developing units 112, photoreceptor drums 113, cleaning units 114, chargers 115, a transfer device 116 according to the present invention, a fusing unit 117 and the like.

Arranged on top of image reader 102 is a document table 120 made of a transparent glass plate on which a document is placed. On the top of document table 120, an automatic document processor 101 for automatically feeding documents is mounted. This document processor 101 is constructed so as to be pivotable along the bidirectional arrow M so that a document can be manually placed by opening the top of document table 120.

The image data handled in image forming portion 103 of the image forming apparatus 100 is data for color images of four colors, i.e., black (K), cyan (C), magenta (M) and yellow (Y). Accordingly, four developing units 112, four photoreceptor drums 113, four chargers 115, four cleaning units 114 are provided to produce four latent images corresponding to black, cyan, magenta and yellow. That is, four imaging stations are constructed thereby.

Charger 115 is the charging means for uniformly electrifying the photoreceptor drum 113 surface at a predetermined potential. Other than the illustrated corona-discharge type chargers, chargers of a contact roller type or a brush type may also be used.

Exposure unit 111 as the image writing device is constructed as a laser scanning unit (LSU) having a laser emitter, reflection mirrors, etc. In this exposure unit 111, a polygon mirror for scanning a laser beam, optical elements such as lenses and mirrors for leading the laser beam reflected off the polygon mirror to photoreceptor drums 113 are laid out. This exposure unit 111 illuminates each of the electrified photoreceptor drums 113 with light in accordance with the input image data to form an electrostatic latent image corresponding to the image data on each photoreceptor drum surface.

Developing units 112 visualize the electrostatic latent images formed on photoreceptor drums 113 with four color (YMCK) toners. Cleaning unit 114 removes and collects the toner left over on the photoreceptor drum 113 surface after development and image transfer.

As shown in FIGS. 1 and 2, a transfer device 116 according to the present invention is arranged over photoreceptor drums 113 and comprised of an intermediate transfer belt 131, four intermediate transfer rollers 132 corresponding to YMCK colors, an intermediate transfer belt drive roller 133, an intermediate transfer belt driven roller 134, a secondary transfer belt 135, a secondary transfer roller 136, a pre-transfer charger ("pre-transfer charging unit" which will be referred to hereinbelow as PTC unit) 137 at a position immediately before the secondary transfer belt 135 over the intermediate transfer belt and an intermediate transfer belt cleaning unit 138.

Intermediate transfer rollers 132, intermediate transfer belt drive roller 133 and intermediate transfer belt driven roller 134 support and tension intermediate transfer belt 131 to circulatively drive the belt. Each intermediate transfer roller 132 provides a transfer bias for transferring the toner image from photoreceptor drum 113 onto intermediate transfer belt 131.

Intermediate transfer belt 131 is arranged so as to contact with every photoreceptor drum 113. The toner images of different colors formed on photoreceptor drums 113 are sequentially transferred in layers to intermediate transfer belt 131, forming a color toner image (multi-color toner image) on intermediate transfer belt 131. This intermediate transfer belt 131 is an endless film of about 100 μm to 150 μm thick, for example.

Transfer of toner images from photoreceptor drums 113 to intermediate transfer belt 131 are performed by intermediate transfer rollers 132 that are in contact with the rear side of intermediate transfer belt 131. Each intermediate transfer roller 132 has a high-voltage transfer bias (high voltage of a polarity (+) opposite to the polarity (−) of the static charge on the toner) applied thereto in order to transfer the toner image. This intermediate transfer roller 132 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer roller 132. Though in the present embodiment, rollers are used as the transfer electrodes, brushes or the like can also be used instead.

As stated above, the visualized electrostatic images of different colors on different photoreceptor drums 113 are laid over one after another on intermediate transfer belt 131. The thus laminated image information is transferred to the sheet as intermediate transfer belt 131 rotates, by an aftermentioned secondary transfer roller 136 that is arranged at the contact position between the sheet and intermediate transfer belt drive roller 133.

In this process, intermediate transfer belt drive roller 133 and secondary transfer roller 136 are pressed against each other forming a predetermined nip while a voltage for transferring the toner to the sheet (a high voltage of a polarity (+) opposite to the polarity (−) of the static charge on the toner) is applied to secondary transfer roller 136. Further, in order to constantly obtain the aforementioned nip, either secondary transfer roller 136 or intermediate transfer belt drive roller 133 is formed of a hard material (metal or the like) while the other is formed of a soft material such as an elastic roller or the like (elastic rubber roller, foamed resin roller etc.).

Since the toner adhering to intermediate transfer belt 131 as the belt comes into contact with photoreceptor drums 113, or the toner which has not been transferred by secondary transfer roller 136 from intermediate transfer belt 131 to the sheet and remains thereon, would cause color contamination of toners at the next operation, the remaining toner is adapted to be removed and collected by intermediate transfer belt cleaning unit 138, as stated above.

Intermediate transfer belt cleaning unit 138 includes, for example a cleaning blade as a cleaning member that comes in contact with intermediate transfer belt 131. Intermediate transfer belt 131 is supported from its interior side by intermediate transfer belt driven roller 134, at the portion where this cleaning blade comes into contact with the belt.

The toner image transferred at each primary transfer position onto the outer peripheral surface of intermediate transfer belt 131 is conveyed by rotation of intermediate transfer belt 131 to the secondary transfer position opposite secondary transfer roller 136. On the other hand, a sheet of paper is fed from an aftermentioned paper feed cassette 160 or manual paper feed tray 161 and conveyed through and between secondary transfer belt 135 and intermediate transfer belt 131. At this time the sheet is impressed by secondary transfer roller 136 with a high voltage of the polarity opposite to that of the static charge on the toner. As a result, the toner image is transferred from the outer peripheral surface of intermediate transfer belt 131 to the sheet surface.

Now, PTC unit 137, which is typically used as a pre-transfer charging unit, will be described.

Since the toner image transferred from photoreceptor drums 113 to intermediate transfer belt 131 contains half-toned areas, solid areas and areas where different amounts of toners are laid over, there a case where the image over the belt has fluctuations in the static charge distribution. There is also a case where separation discharge occurs at the gap on the downstream side next to the primary transfer portion with respect to the moving direction of the intermediate transfer belt, causing variations in the amount of static charge over the toner image on intermediate transfer belt 131 after primary transfer.

Such variation in the amount of static charge within the same toner image will lower the transfer margin or stability in transferring the toner image on intermediate transfer belt 131 to the sheet. This is why PTC unit 137 is used. That is, it is a common practice that PTC unit 137 is used to uniformly electrify the toner image before transfer to the sheet so as to eliminate the variation in the amount of static charge within the same toner image and improve the transfer margin in secondary transfer.

Arranged in paper feed unit 105 of image forming apparatus 100 under exposure unit 111 is a paper feed cassette 160 as a tray for stacking sheets to be used for image forming. There is also a manual paper feed cassette 161, on which sheets for image forming can be set.

A paper output tray 162 arranged in the upper part of image forming portion 103 is a tray on which the printed sheets are collected facedown.

The sheet conveyor arrangement, designated at 104, includes a paper feed path S that extends approximately vertically to convey the sheet from paper feed cassette 160 or manual paper feed cassette 161 to paper output tray 162 by way of fusing unit 117 etc. Arranged along paper feed path S from paper feed cassette 160 or manual paper feed cassette 161 to paper output tray 162 are pickup rollers 163*a* and 163*b*, a plurality of feed rollers 164*a* to 164*d*, a registration roller 165, fusing unit 117 and the like.

Feed rollers 164*a* to 164*d* are small rollers for promoting and supporting conveyance of sheets and are arranged at different positions along paper feed path S. Pickup roller 163*a* is arranged near the end of paper feed cassette 160 so as to pickup the paper, sheet by sheet, from paper feed cassette 160 and deliver it to paper feed path S. Similarly, pickup roller 163*b* is arranged near the end of manual paper feed cassette 161 so as to pick up the paper, sheet by sheet, from manual paper feed cassette 161 and deliver it to paper feed path S.

Registration roller 165 temporarily retains the sheet that is conveyed along paper feed path S. That is, this roller delivers the sheet toward secondary transfer belt 135 at such a timing that the front end of the sheet will meet the front end of the toner image formed on intermediate transfer belt 131.

Fusing unit 117 includes a heat roller 171 and a pressing roller 172. Heat roller 171 and pressing roller 172 are arranged so as to rotate while nipping the sheet. This heater roller 171 is set at a predetermined fusing temperature by the controller in accordance with the signal from an unillustrated temperature detector, and has the function of heating and pressing the toner to the sheet in cooperation with pressing roller 172, so as to thermally fix the toner image transferred on the sheet to the sheet by fusing, mixing and pressing the color image of multiple toners. The fusing unit further includes an external heating belt 173 for heating heat roller 171 from without.

The sheet passes through fuser unit 117, whereby the unfixed toner on the sheet is fused by heat and fixed. Then the sheet is discharged through feed rollers 164*b* arranged downstream, onto paper output tray 162.

The paper feed path described above is that of the sheet for a one-sided printing request. In contrast, when a duplex printing request is given, the sheet with its one side printed passes through fusing unit 117 and is held at its rear end by the final feed roller 164*b*, then the feed roller 164*b* is rotated in reverse so as to lead the sheet toward feed rollers 164*c* and 164*d*. Thereafter, the sheet passes through registration roller 165 and is printed on its rear side and discharged onto paper output tray 162.

<Basic Concept of Operation of the Transfer Device of the Present Invention and Specific Explanation of its Electric Configuration and Operation>

Next, the basic concept of operation and electric configuration and specific operation for stabilizing the ability of cleaning the secondary transfer belt and reducing cleaning time in transfer device 116 according to the present invention provided for the above-described image forming apparatus 100 will be described hereinbelow.

First, the basic concept of operation will be described with reference to FIGS. 3 and 4.

Figure 3:
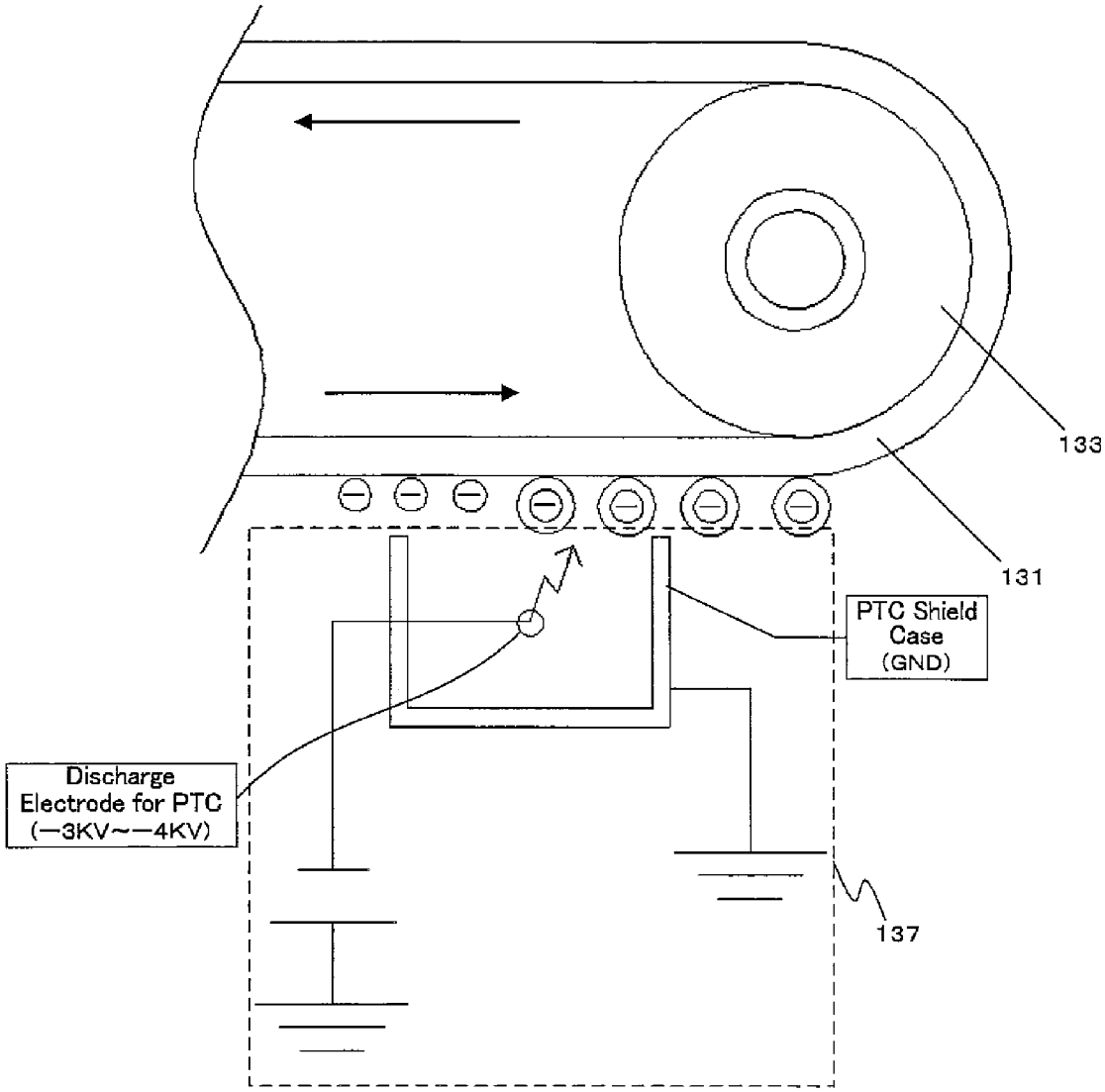
FIG. 3 is an enlarged view showing an area where a PTC unit in a transfer device according to the present invention is arranged.

FIG. 3 is an enlarged view showing an area where the PTC unit in the transfer device according to the present invention is arranged.

Figure 4:
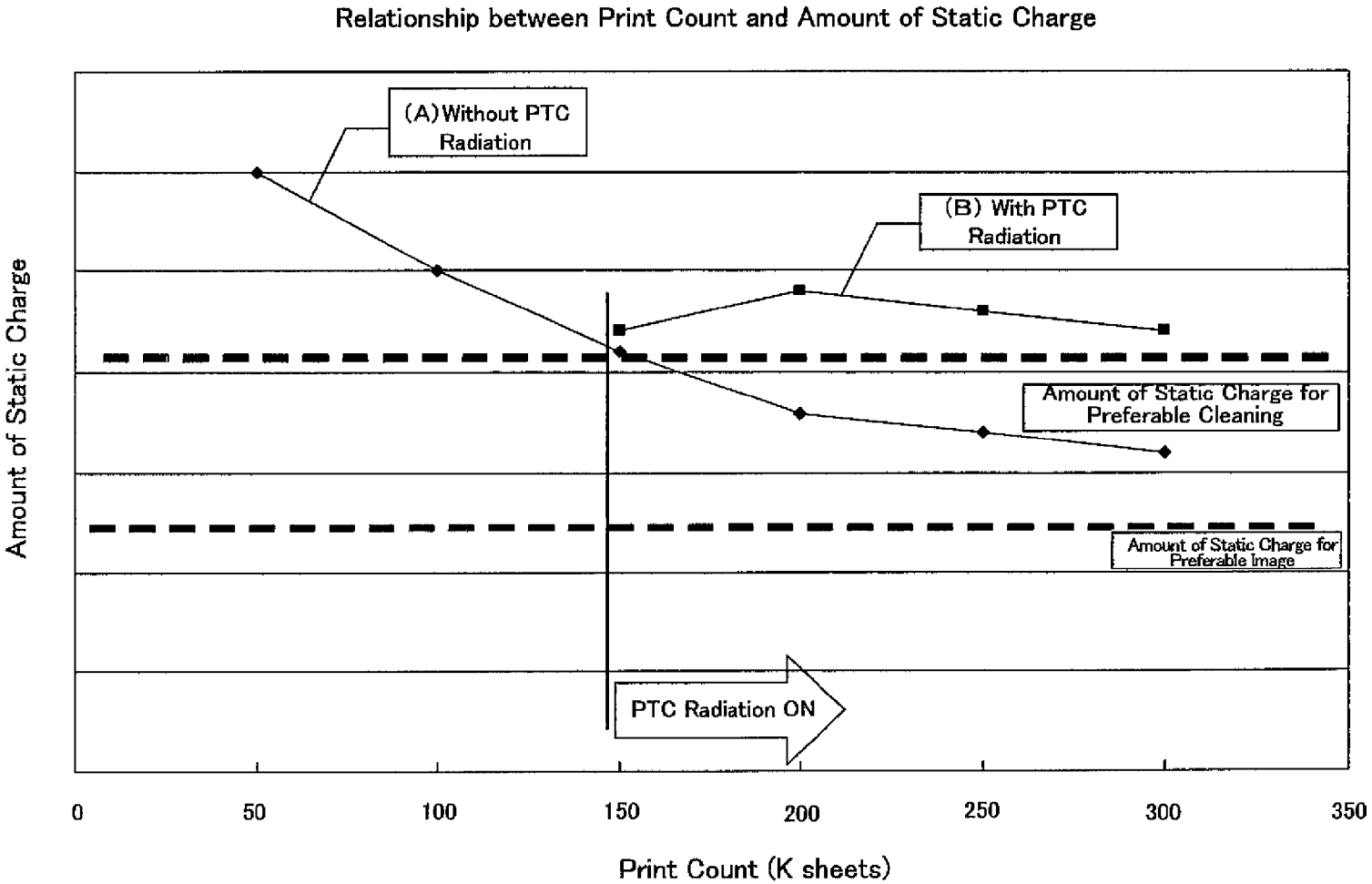
FIG. 4 is a chart showing the relationship between the print count and the amount of static charge on toner.

FIG. 4 is a chart showing the relationship between the print count and the amount of static charge on toner.

Usually, the amount of static charge on toner lowers with increase in the total print count (predictive information), as seen in the graph by plot (A) when no PTC radiation is done in FIG. 4. When the total print count exceeds 150 (K sheets), the amount of static charge on the toner falls below the threshold above which the residual toner will return properly (deterioration of the amount of static charge on toner). Accordingly, it is possible to predict degradation of cleaning performance.

On the basis of the prediction of the lowering of cleaning performance, PTC radiation is turned "ON" when the total print count reaches 150 (K sheets) so as to make correction to the amount of static charge on the toner (increase the amount of static charge) by PTC irradiation as shown in FIG. 3. With this effect, even when the total print count exceeds 150 (K sheets), it is possible to secure the static charge on the toner so that the residual toner can properly return from the secondary transfer belt to the primary transfer belt as shown in the graph by plot (B) when PTC radiation is done in FIG. 4, and hence prevent lowering of cleaning performance without causing the amount of static charge to fall below the threshold level below which cleaning ability is poor.

As described above, prediction of the lowering of the amount of static charge on toner based on the total print count and implementation of PTC radiation make it possible to stabilize the performance of cleaning the secondary transfer belt, hence reduce cleaning time.

Figure 5:
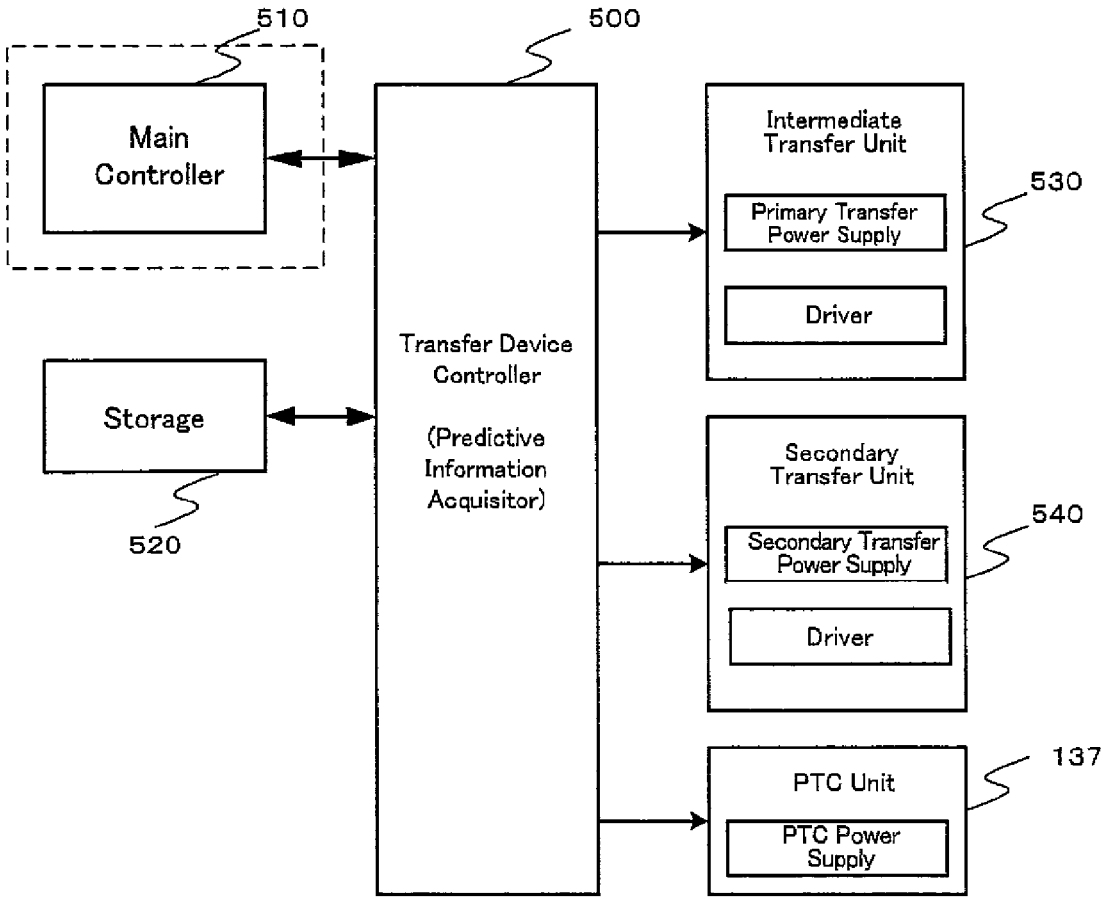
FIG. 5 is a block diagram showing an electrical configuration of a transfer device according to the present invention; and, FIG. 6 is a flow chart showing a control operation of a transfer device according to the present invention.
Figure 6:
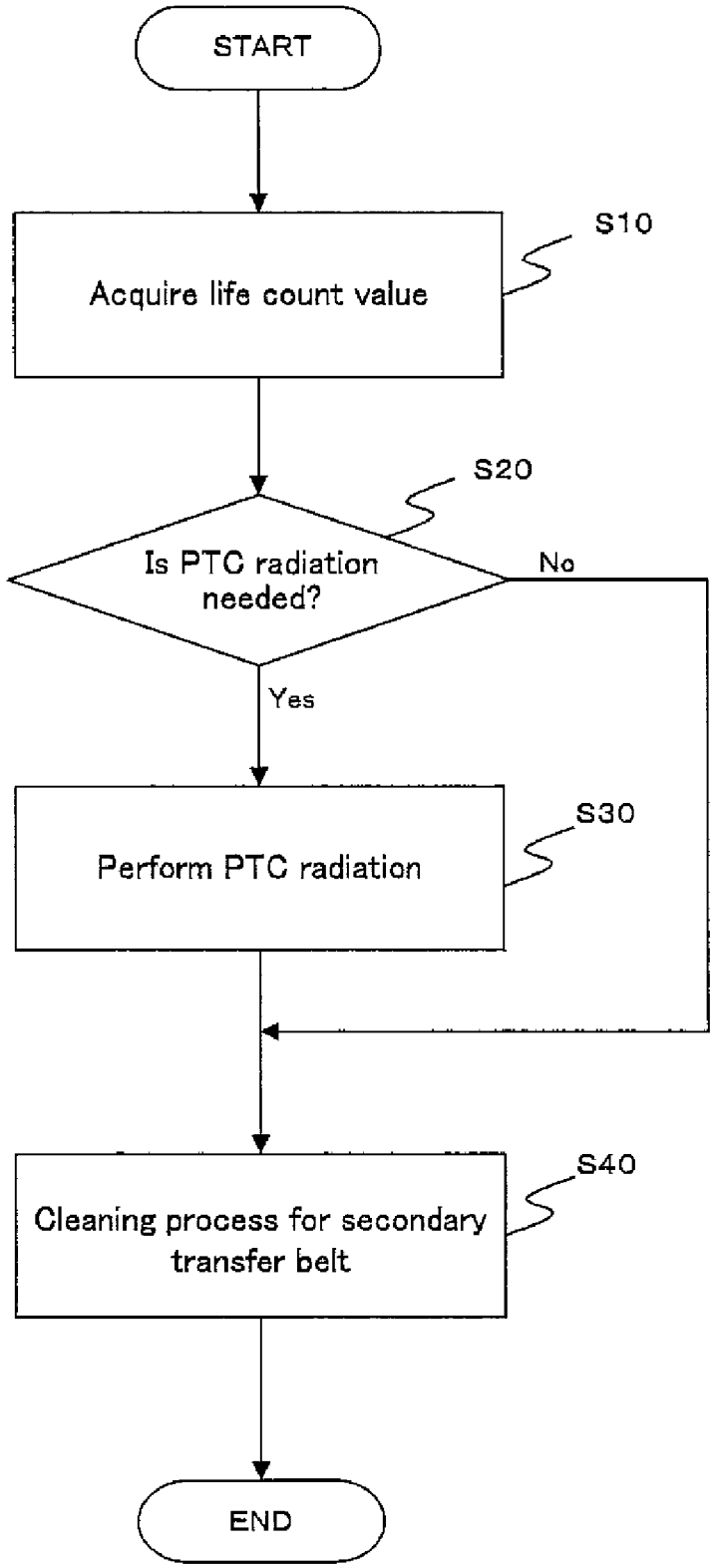

Referring next to FIGS. 5 and 6, the electric configuration of the transfer device according to the present invention and its operation based on the above-described basic concept will be described.

FIG. 5 is a block diagram showing an electrical configuration of the transfer device according to the present invention.

FIG. 6 is a flow chart showing a control operation of the transfer device according to the present invention.

As shown in FIG. 5, transfer device 116 includes a transfer device controller 500 for controlling the whole device, a storage 520 for storing diverse kinds of data etc. necessary for control, an intermediate transfer unit 530 including a primary transfer power supply and its driver, a secondary transfer unit 540 including a secondary transfer power supply and its driver, and PTC unit 137.

Though in FIG. 5, transfer device controller 500 for controlling the transfer device is provided separately from the main controller, designated at 510, for controlling the whole image forming apparatus, main controller 510 may be configured so as to control the transfer device.

Transfer device controller 500 communicates with main controller 510 that controls the whole image forming apparatus, and acquires, for example, information on the total print count or the like (predictive information acquisitor), and determines based on the information whether PTC radiation should be performed, and controls drive of PTC unit 137 when PTC radiation is determined to be needed. Then, the controller controls intermediate transfer belt unit 530 and secondary transfer unit 540 to perform a cleaning process. At this time, the controller may load the necessary control data etc. from storage 520 and may store the result in progress and like.

The control operation of the transfer device controller 500 thus constructed will be described referring to the flow chart in FIG. 6.

To begin with, the number of current total printouts is counted and the result is stored into a life counter. The counter value on the life counter is acquired from main controller 510 (Step S10). The obtained life counter value is compared with a predetermined threshold so as to determine whether correction to the amount of static charge on the toner (increase of the amount of static charge) by PTC unit 137 is needed (Step S20). When it is determined that correction is needed (Step S20; Yes), then PTC unit 137 is controlled to give off radiation (Step S30). Then, intermediate transfer belt unit 530 and secondary transfer unit 540 are controlled to clean the secondary transfer belt (Step S40) to complete the process.

On the other hand, when it is determined that no correction is needed (Step S20; No), the control directly enters the cleaning process of the secondary transfer belt at Step S40.

Here, as to the life counter value, the count value may be automatically updated every page.

Also, the controlled voltage value for radiation from PTC unit 137 may be varied in accordance with the lifetime of the image forming apparatus.

As to the timing at which the cleaning process of the aforementioned secondary transfer belt is started, since unnecessary toner is prone to occur when image patches are formed for image quality control, the cleaning may be adapted to start at the end of the patch image control so as to be able to remove the unnecessary toner.

Cleaning for an image quality control process is performed in widely used electrophotographic image forming apparatuses based on electrostatic force, as disclosed in "Japanese Patent Application Laid-open 2005-84543". In such an electrophotographic image forming apparatus, for example the sensitivities of the photoreceptor drums, toner transfer efficiency and other characteristics vary depending on the usage conditions of each processing unit and ambient conditions. When these characteristics change, the density of the formed image becomes prone to vary and the image quality becomes prone to be lowered.

In order to prevent such degradation of image quality, the control conditions of individual components of the image forming portion (charger output, exposure intensity, developing bias, transfer bias, etc.) need to be adjusted following the predetermined conditions so as to achieve such an image quality control that can constantly provide desirable image quality.

This image quality control is performed by forming test image patches (grayscale pattern) at a predetermined timing and adjusting the aforementioned control conditions based on the measurements of the test density patches by a density detector. Here, the test grayscale pattern is measured at the timing after the toner patches are formed on the image bearer or after the toner patches are formed and transferred to the transfer support.

As to the timing for starting the cleaning process of secondary transfer belt 135 other than the above, since unnecessary toner is prone to occur at the end of one print job in the image forming apparatus, the cleaning may be adapted to start at the end of each print job.

As has been described heretofore, cleaning of secondary transfer belt 135 is to be done when unnecessary toner arises on secondary transfer belt 135, hence the cleaning may be carried out at any time other than that in the present embodiment. Also in such a case, it goes without saying that the equivalent effect can be obtained by applying the present invention.

Further, the present embodiment has been described taking an example of a color image forming apparatus (multifunctional machine, printer etc.), but it goes without saying that the invention can be applied to a monochrome image forming apparatus using a transfer belt or an intermediate transfer belt.

What is claimed is:

1. A transfer device comprising:

a secondary transfer element for transferring the toner on a primary transfer element to print paper;

a pre-transfer charging unit for increasing the amount of static charge on the toner before the toner on the primary transfer element transfers to the secondary transfer element;

a predictive information acquisitor for acquiring predictive information for previously detecting occurrence of cleaning failure in the secondary transfer element; and a controller for causing the pre-transfer charging unit so as to control the amount of static charge on the toner on the primary transfer element, wherein the controller compares the predictive information obtained from the predictive information acquisitor with a predetermined threshold, and makes control so as to increase the amount of static charge when detecting the predictive information falling below the threshold, and determining that cleaning failure can occur.

2. The transfer device according to claim 1, wherein the pre-transfer charging unit is arranged over the primary transfer element at a position immediately before the secondary transfer element.

3. The transfer device according to claim 1, wherein the predictive information is the total print count.

4. The transfer device according to claim 1, wherein the controller causes the pre-transfer charging unit to vary the drive condition of charging based on the total print count.

5. The transfer device according to claim 1, wherein the controller performs a cleaning process of the secondary transfer element at the time when image quality control for an image forming apparatus is practiced.

6. The transfer device according to claim 1, wherein the controller performs a cleaning process of the secondary transfer element every time one print job of an image forming apparatus has been finished.

7. An image forming apparatus, comprising: a transfer device according to claim 1.

* * * * *